US006499191B1

(12) United States Patent
Howie, Jr.

(10) Patent No.: US 6,499,191 B1
(45) Date of Patent: Dec. 31, 2002

(54) KNOB WITH A COMPOSITE LIGHT PIPE HAVING A COLORED FACE AND A LIGHT PIPE

(75) Inventor: Robert K. Howie, Jr., Decatur, IL (US)

(73) Assignee: The Grigoleit Company, Decatur, IL (US)

( * ) Notice: Subject to any disclaimer, the term of this patent is extended or adjusted under 35 U.S.C. 154(b) by 0 days.

(21) Appl. No.: 10/171,885

(22) Filed: Jun. 14, 2002

Related U.S. Application Data

(63) Continuation of application No. 09/607,060, filed on Jun. 29, 2000, now abandoned.

(51) Int. Cl.[7] ..... E05B 1/00

(52) U.S. Cl. ..... 16/441; 362/26; 362/30; 362/551; 16/DIG. 18

(58) Field of Search ..... 16/441, DIG. 18; 362/26, 27, 30, 551, 582, 31, 558; 116/286, 309, 310, 318, DIG. 36

(56) References Cited

U.S. PATENT DOCUMENTS

| | | | | | |
|---|---|---|---|---|---|
| 2,185,492 | A | | 1/1940 | Barrett | |
| 2,193,586 | A | | 3/1940 | Fischett | |
| 2,831,453 | A | | 4/1958 | Hardesty | |
| 3,514,366 | A | | 5/1970 | Allport | |
| 3,543,329 | A | | 12/1970 | Gulette et al. | |
| 3,619,594 | A | | 11/1971 | Morez | |
| 4,155,972 | A | | 5/1979 | Hauser et al. | |
| 4,603,065 | A | | 7/1986 | Mori et al. | |
| 5,040,479 | A | * | 8/1991 | Thrash | 200/314 |
| 5,095,409 | A | | 3/1992 | Dematteo et al. | |
| 5,098,633 | A | | 3/1992 | Hausler | |
| 5,159,892 | A | | 11/1992 | Hara et al. | |
| 5,359,165 | A | * | 10/1994 | Leveque et al. | 200/317 |
| 5,376,314 | A | | 12/1994 | Share et al. | |
| 5,477,024 | A | | 12/1995 | Share et al. | |
| 5,641,556 | A | * | 6/1997 | Howie, Jr. | 428/195 |
| 5,695,269 | A | * | 12/1997 | Lippmann et al. | 362/27 |
| 5,697,689 | A | * | 12/1997 | Levine et al. | 362/26 |
| 5,752,759 | A | * | 5/1998 | Pizzo | 362/26 |
| 5,811,175 | A | | 9/1998 | Howie, Jr. | |
| 5,845,365 | A | | 12/1998 | Howie, Jr. | |
| 6,003,206 | A | * | 12/1999 | Hall et al. | 362/26 |
| 6,019,478 | A | * | 2/2000 | Pizzo | 362/26 |

* cited by examiner

*Primary Examiner*—Chuck Y. Mah
(74) *Attorney, Agent, or Firm*—Cook, Alex, McFarron, Manzo, Cummings & Mehler, Ltd.

(57) ABSTRACT

A composite knob having a plastic core with a front wall. A narrow passage or slit extends through the front wall of the core. A thin, elongated planar light pipe formed of a first piece of a clear light transmitting plastic and a second piece of a colored light transmitting plastic overlay attached to the light emitting edge or face of the first piece of clear light transmitting plastic. The colored plastic overlay is secured to the first piece of clear light transmitting plastic by pairs of notches and hooks which interlock during the molding of the overlay to the clear portion. The light pipe is positioned in the plastic core with the colored overlay located in the narrow passage and visible through the core from the exterior of the knob. In another embodiment, a window is formed in the front wall of a translucent plastic core. The light pipe is positioned in the translucent plastic core so as to transmit light through the window of said translucent plastic core.

12 Claims, 1 Drawing Sheet

Fig. 1.
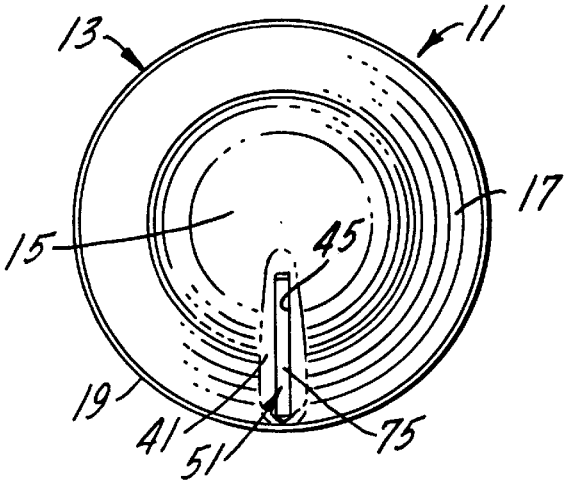
Fig. 2.
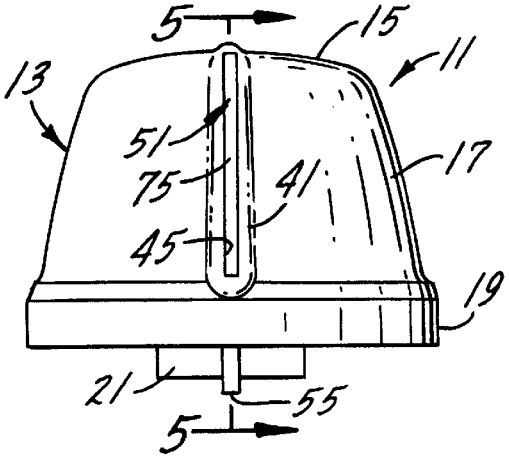
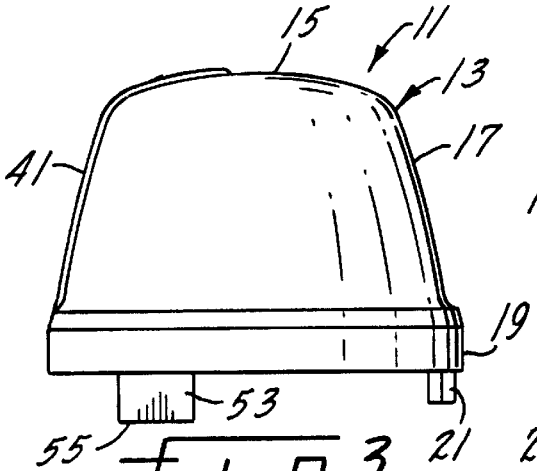
Fig. 3.
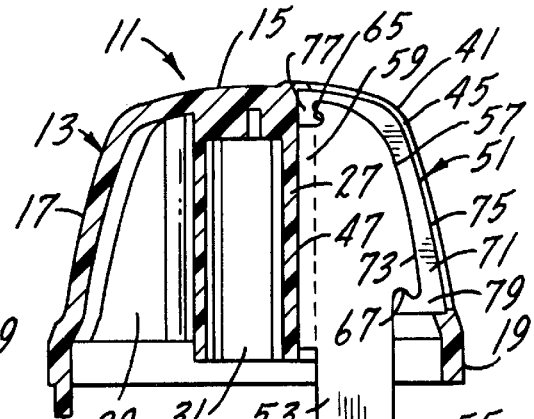
Fig. 5.
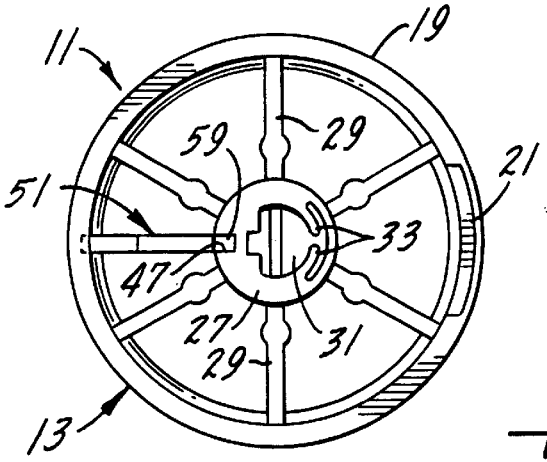
Fig. 4.
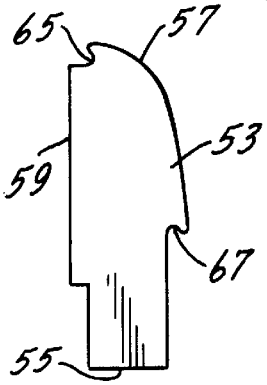
Fig. 6.
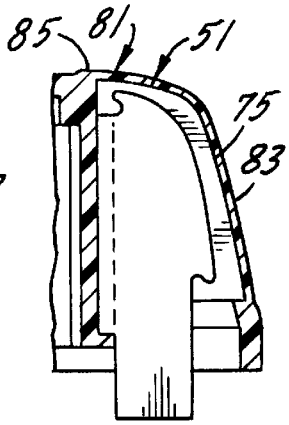
Fig. 7.

KNOB WITH A COMPOSITE LIGHT PIPE HAVING A COLORED FACE AND A LIGHT PIPE

This application is a continuation of application Ser. No. 09/607,060, filed Jun. 29, 2000 now abandoned. The entire disclosure of said prior application is considered as part of the disclosure of this application and is incorporated herein by reference.

BACKGROUND AND SUMMARY OF THE INVENTION

This invention is directed to a composite knob having a light pipe with a colored face used as an indicator and to a light pipe for incorporation in such a composite knob.

Light pipes formed of light transmitting plastic are used in instrument panels and knobs of various types installed in vehicles and vessels. It is desirable in many such applications to provide light pipes of specific colors, rather than using a clear light pipe. However, the light transmitting capabilities of a colored plastic light pipe are usually less than that of a light pipe made from a clear light transmitting plastic. Thus, the visibility or uniformity of brightness of a colored light pipe may be severely diminished if the light pipe is unusually long or if the light source is particularly weak. It should be understood that the term color as used herein can mean any color of the spectrum including white and that the color can vary in any degree of transparency from almost clear to translucent to near opaque. The term "clear" refers to a material having the appearance of clear glass.

Previous attempts to provide colored light pipes have included the application of colored films to the light emitting edges of clear light pipes. Such attempts have been unsatisfactory due to inadequate adhesion between the color film and the plastic of the light pipe, the poor wearing qualities of the color film and the labor intensive nature inherent in attaching a film to a light pipe.

Accordingly, an object of this invention is a light pipe which emits a colored light yet has light transmitting characteristics almost equivalent to those of a clear light pipe.

Another object of this invention is a light pipe comprised of two plastics, one clear and the other colored, which are securely fastened to each other.

Yet another object of this invention is a light pipe comprised of a clear plastic and a colored plastic in which one or both of the clear or colored plastics may be varied in light transmitting distance thickness to balance the light output of the light pipe according to the characteristics which are desired.

Still another object of this invention is a light pipe of two plastics, one clear and the other colored, in which the light transmitting distance across the colored plastic is much shorter than the light transmitting distance across the clear light transmitting plastic.

Still a further object of this invention is a knob incorporating any of the aforementioned light pipes which light pipe is visible from the exterior of the knob either through an opening formed in the knob or through a transparent or translucent window formed in the knob.

An additional object of this invention is a multi-part light pipe is formed by molding the parts of the light pipe in a multi-step process or by pre-manufacturing some of the parts and overmolding the other parts on the pre-manufactured parts.

Other objects of the invention will be found in the following specification, claims and drawings.

BRIEF DESCRIPTION OF THE DRAWINGS

The invention is illustrated more or less diagrammatically in the following drawings wherein:

FIG. 1 is a top plan view of a knob incorporating the composite light pipe of this invention;

FIG. 2 is a front elevational view of the knob of FIG. 1;

FIG. 3 is a side elevational view of the knob of FIG. 1;

FIG. 4 is a bottom plan view of the knob of FIG. 3;

FIG. 5 is a cross sectional view taken along line 5—5 of FIG. 2;

FIG. 6 is a side elevational view of a component of the light pipe of this invention; and FIG. 7 is a partial, cross section view of a modified knob having a window incorporating the composite light pipe of this invention.

DESCRIPTION OF THE PREFERRED EMBODIMENTS

A first embodiment of a plastic article in the form of a composite knob 11 embodying the novel features of this invention is shown in FIGS. 1–5 of the drawings. The knob includes a dome-shaped, hollow body 13 having a front wall 15 and a skirt 17 terminating in a rearwardly located flange 19. Formed integral with the flange 19 is an arcuate indexing projection 21.

Also formed integrally with the composite knob 11 is a hub 27 with ribs 29 extending between the hub and the dome 13. The hub has a socket 31 with gripping fingers 33. A fin 41 extends outwardly from the front wall 15 and skirt 17 of the dome 13. An elongated slit 45 extends through the fin and a guide slot 47 shown in FIG. 4 is formed in the hub in alingment with the slit 45.

A composite light pipe 51 is inserted in the composite knob to transmit light through the elongated slit 45 which extends through the fin 41 projecting outwardly from the front wall 15 and skirt 17 of the dome-shaped, hollow body 13 as can be seen most clearly in FIGS. 1, 2, 3 and 5 of the drawings. The light pipe 51, as shown in FIG. 6 of the drawings, includes an elongated planar body 53 formed of a clear light transmitting plastic. The clear light transmitting plastic is preferably formed from a sheet of material of sufficient thickness that the planar body 53 is self supporting. However, it should be appreciated that the body 53 may be molded. The elongated planar body 53 has a light receiving edge or face 55 and a light emitting edge or face 57 at the opposite ends thereof. The light receiving edge or face 55 is intended to be positioned adjacent a light source such as a bulb, which is not shown in the drawings, but is well known in the art. The body 53 also includes a guide slot seating edge 59 as well as notches 65 and 67 located at opposite ends of the light emitting edge or face 57.

As can best be seen in the drawings, especially FIGS. 5 and 7, the distance light travels through the planar body 53 from the light receiving edge 55 to the light transmitting edge 57 of the body is not uniform but varies across the length of the light emitting edge. A measured distance from the light receiving edge 55 anywhere along its length to the light emitting edge 57 of the planar body 53 adjacent the notch 65 is longer than a measured distance from the light receiving edge 55 to the light emitting edge 57 adjacent the notch 67. These varying distances can be referred to as the light transmitting distances of the planar body 53.

A colored light pipe overlay 71 is formed of plastic having a light receiving edge or face 73 which contacts the light emitting edge or face 57 of the light pipe planar body 53 and a light emitting edge or face 75 at the opposite side of the overlay. The distance between the light receiving face 73 and the light emitting face 75 is the distance the light must travel. While this distance is not critical, it will always be greater than the thickness of a colored film of the type previously used so that the overlay will have better wearing qualities than would be obtained from a colored film. Accordingly, as used in this specification and claims, the terms "overlaid" and "overlay" mean a material thicker than a plastic film. The overlay 71 may be red, green or orange in color as is conventional for such indicators. The colored light pipe overlay 71 is attached to the elongated planar body 53 with hooks 77 and 79 engaging notches 65 and 67, respectively, to fasten the colored overlay 71 to the elongated planar body 53 of clear light transmitting plastic thus forming the composite light pipe 51. Whereas, in this embodiment, the notches are formed in the elongated body 53 and the hooks are formed in the overlay 71, their positions could be reversed without departing from the teachings of this invention. Other methods may be used to securely attach such an overlay 71 to the body 53 to form a composite light pipe.

As can best be seen in the drawings, especially FIGS. 5 and 7, the distance between the light receiving face 73 and the light emitting face 75 of the overlay 71 is not uniform but varies between the hooks 77 and 79 with the distance being shorter adjacent the hook 77 than adjacent the hook 79. These varying distances can be referred to as the light transmitting distances of the overlay 71.

Therefore, as can best be seen most clearly in the drawings, the overlay 71 has its shortest light transmitting distance aligned with the longest light transmitting distance of the planar body 53 which is located proximate to the hook 75 and the notch 65. Further, the overlay 71 has its longest light transmitting distance adjacent the shortest light transmitting distance of the planar body 53 which is located proximate to the hook 79 and notch 67. Thus, the light output of the light pipe can be balanced throughout its light emitting length as previously mentioned on page 2 herein at [0007].

In manufacture of one embodiment of the composite knob 11 of this invention, the elongated planar body 53 of clear plastic for the composite light pipe 51 is first formed by molding, stamping or cutting, whichever is most economical. Then the colored light pipe overlay 71 is molded onto the planar body 53 to form a colored light emitting edge or face for the composite light pipe 51. The composite light pipe 51 is then inserted into a mold and the dome-shaped, hollow body 13 is molded around the composite light pipe 51 with the colored light pipe overlay 71 extending through the slit 45 in the fin 41 as shown in the finished composite knob 11 of FIGS. 1–5 of the drawings.

Although the elongated planar body 53 may first be formed by molding, stamping or molding and the overlay 71 molded onto the body 53 to form the composite light pipe 51, which is then inserted into a mold for the body 13, it should also be understood and appreciated that the body 53, overlay 71 and body 13 may be formed in a multi-step molding process sometimes referred to as a "two shot" or a "three shot" process.

The composite light pipe 51 of this invention is also adaptable to knobs 81 of the type which do not utilize a slit or narrow passage through the outer wall of the plastic, hollow body but instead are formed with what is referred to as a "window", usually a defined portion 83 of the outer or front wall 85 of the translucent plastic body which is usually thinner than the generally uniform thickness of the plastic body front wall as shown in FIG. 7 of the drawings. Such knobs and the method of making them are described in my U.S. Pat. No. 5,845,365, issued Dec. 8, 1998, which is incorporated in this application by reference.

When the composite light pipe 51 is installed in a composite knob 81 of the type shown in FIG. 7 of the drawings, the light emitting face or edge 75 of the light pipe will be in contact with or closely adjacent what is called the "window" of the knob. Thus, the light pipe 51 of this invention will transmit colored light more efficiently and uniformly through the "window" 83 of the composite knob 81 than will a conventional light pipe.

What is claimed is:

1. A composite knob including:

a plastic body having a front wall, a passage extending through said front wall, and a composite light pipe having an elongated first portion formed of a clear light transmitting plastic with a light emitting face at one end thereof, and a second portion formed of a colored light transmitting plastic overlaid on said light emitting face of said first portion of said light pipe, said first portion having a light receiving face spaced from said light emitting face with light transmitting distances between said first portion faces, said second portion having a light receiving face and a light transmitting face with light transmitting distances between said second portion faces, said light transmitting distances of said second portion being substantially shorter than said light transmitting distances of said first portion, said light transmitting distances of said second portion being shorter at one end of said light emitting face than at the other end, said composite light pipe positioned in said plastic body with said colored light transmitting overlay located in said passage so as to transmit light to the exterior of said knob.

2. The composite knob of claim 1 in which said light emitting face of said first portion is an edge, a cutout forming a hook is located at each of opposite ends of said light emitting edge of said first portion and said colored light transmitting overlay of said second portion meshes with said cutouts to secure said overlay to said light emitting edge of said first portion of said composite light pipe.

3. The composite knob of claim 1 in which said overlay is formed by injection molding.

4. The composite knob of claim 1 in which said first portion of said light pipe has light transmitting distances that are longer at one end of said light emitting face thereof than at said other end and said second portion of said light pipe is overlaid on said first portion with said shorter light transmitting distances at one end thereof aligned with said longer light transmitting distances at said one end of said first portion.

5. A composite knob including:

a plastic body having a front wall, a window forward in said front wall, and an elongated composite light pipe having a first portion formed of a clear light transmitting plastic with a light emitting face at one end thereof, and a second portion formed of a colored light transmitting plastic overlaid on said light emitting face of said first portion of said light pipe, said first portion having a light receiving face spaced from said light emitting face with light transmitting distances between said first portion faces, said second portion having a light receiving face and a light transmitting face with light transmitting distances between said second portion faces, said light transmitting distances of said second portion being substantially shorter than said light transmitting distances of said first portion, said light transmitting distances of said second portion being shorter at one end of said light emitting face than at the other end, said elongated composite light pipe positioned in said plastic body with said colored light transmitting overlay located in said window so as to transmit light through said window to the exterior of said knob.

6. The composite knob of claim 5 in which a cutout forming a hook is located at each of opposite ends of said light emitting face of said first portion of said light pipe and said color transmitting overlay of said second portion meshes with said cutouts to secure said overlay to said light emitting face of said first portion of said composite light pipe.

7. The composite knob of claim 5 in which said overlay is formed by injection molding.

8. The composite knob of claim 5 in which said first portion of said light pipe has light transmitting distances that are longer at one end of said light emitting face thereof than at said other end and said second portion of said light pipe is overlaid on said first portion with said shorter light transmitting distances at one end thereof aligned with said longer light transmitting distances at said one end of said first portion.

9. A composite light pipe having an elongated first portion formed of a clear light transmitting plastic with a light emitting face at one end thereof, and a second portion formed of a colored light transmitting plastic overlaid on said light emitting face of said first portion, said first portion having a light receiving face and a light emitting face with light transmitting distances between said faces, said second portion having a light receiving face and a light transmitting face with light transmitting distances between said faces, said light transmitting distances of said second portion being substantially shorter than said light transmitting distances of said first portion.

said light transmitting distances of said second portion being shorter at one end of said light emitting face than at the other end.

10. The composite light pipe of claim 9 in which a notch is formed on each of said opposite sides of said light emitting face of said first portion of clear light transmitting plastic and said second portion of colored light transmitting overlay is formed with hooks which engage said notches to secure said overlay to said first portion of clear light transmitting plastic.

11. The composite light pipe of claim 9 in which said second portion of said colored light transmitting plastic overlay is formed by injection molding.

12. The composite light pipe of claim 9 in which said first portion of said light pipe has light transmitting distances that are longer at one end of said light emitting face thereof than at said other end and said second portion of said light pipe is overlaid on said first portion with said shorter light transmitting distances at one end thereof aligned with said longer light transmitting distances at said one end of said first portion.

* * * * *